US006964416B2

(12) United States Patent
McClintic et al.

(10) Patent No.: US 6,964,416 B2
(45) Date of Patent: Nov. 15, 2005

(54) METHOD OF PLAYING A MATCHING BONUS GAME

(75) Inventors: Monica A. McClintic, Boulder City, NV (US); Michael T. Tessmer, Bozeman, MT (US); Julie A. Mottes, Henderson, NV (US); William E. Vorias, Henderson, NV (US)

(73) Assignee: IGT, Reno, NV (US)

( * ) Notice: Subject to any disclaimer, the term of this patent is extended or adjusted under 35 U.S.C. 154(b) by 34 days.

(21) Appl. No.: 10/027,928

(22) Filed: Dec. 21, 2001

(65) Prior Publication Data

US 2003/0119580 A1 Jun. 26, 2003

(51) Int. Cl.[7] ..... A63F 9/22
(52) U.S. Cl. ..... 273/273; 463/16
(58) Field of Search ..... 273/273; 463/16

(56) References Cited

U.S. PATENT DOCUMENTS

| | | | | | |
|---|---|---|---|---|---|
| 5,411,271 | A | * | 5/1995 | Mirando | 463/9 |
| 5,431,408 | A | | 7/1995 | Adams | 273/306 |
| 5,664,998 | A | | 9/1997 | Seelig et al. | |
| 5,803,451 | A | | 9/1998 | Kelly et al. | 273/118 R |
| 5,823,874 | A | | 10/1998 | Adams | 463/17 |
| 5,848,932 | A | | 12/1998 | Adams | 463/20 |
| 5,882,261 | A | | 3/1999 | Adams | 463/20 |
| 5,980,384 | A | | 11/1999 | Barrie | 463/16 |
| 6,015,346 | A | * | 1/2000 | Bennett | 463/20 |
| 6,050,895 | A | | 4/2000 | Luciano, Jr. et al. | |
| 6,089,976 | A | | 7/2000 | Schneider et al. | 463/16 |
| 6,089,978 | A | | 7/2000 | Adams | 463/20 |
| 6,120,031 | A | | 9/2000 | Adams | 273/292 |
| 6,149,156 | A | | 11/2000 | Feola | 273/292 |
| 6,173,955 | B1 | | 1/2001 | Perrie et al. | 273/146 |
| 6,174,235 | B1 | * | 1/2001 | Walker et al. | 463/25 |
| 6,179,711 | B1 | | 1/2001 | Yoseloff | 463/25 |
| 6,190,255 | B1 | | 2/2001 | Thomas et al. | |
| 6,203,429 | B1 | | 3/2001 | Demar et al. | |
| 6,210,275 | B1 | | 4/2001 | Olsen | |
| 6,227,969 | B1 | | 5/2001 | Yoseloff | 463/13 |
| 6,261,177 | B1 | * | 7/2001 | Bennett | 463/16 |
| 6,287,197 | B1 | | 9/2001 | Dickinson et al. | 463/31 |
| 6,315,664 | B1 | | 11/2001 | Baerlocher et al. | |
| 6,346,043 | B1 | * | 2/2002 | Colin et al. | 463/17 |
| 6,514,144 | B2 | | 2/2003 | Riendeau et al. | 463/42 |
| 6,572,471 | B1 | * | 6/2003 | Bennett | 463/16 |
| 6,582,303 | B1 | | 6/2003 | Weiss | 463/16 |
| 6,605,001 | B1 | | 8/2003 | Tarantino | 463/22 |

(Continued)

FOREIGN PATENT DOCUMENTS

| | | |
|---|---|---|
| EP | 1 008 968 | 6/2000 |
| GB | 2 262 642 | 6/1993 |
| WO | WO 01/19476 | 3/2001 |

OTHER PUBLICATIONS

"Who Wants to be a Millionaire?" (RTM) Quiz machine. As featured at URL: http://www.blazej.demon.co.uk/tplc/yourown.html. (Please see printout.).

*Primary Examiner*—Corbett Coburn
(74) *Attorney, Agent, or Firm*—Marshall, Gerstein & Borun LLP

(57) ABSTRACT

The method includes a bonus game associated with a base game that allows players to use skill and memory to determine the outcome of the bonus game. Players are prompted at the beginning of the bonus game to select at least a first and then a second game space from an array of game spaces, revealing previously hidden indicia. The player continues the selections for a predetermined period of time or until some event occurs, terminating the selections. Bonus payouts are awarded in the event the revealed indicia match. Alternative embodiments include allowing players to qualify for a "sneak peek", wherein all or some hidden indicia on the game space array are revealed for a short period of time, and random shuffling of the indicia to different game spaces.

11 Claims, 7 Drawing Sheets

U.S. PATENT DOCUMENTS 6,612,575 B1 9/2003 Cole et al.
6,620,045 B2 9/2003 Berman et al. ..... 463/25
6,669,559 B1 * 12/2003 Baerlocher et al. ..... 463/16
6,746,328 B2 6/2004 Cannon et al. ..... 463/17
2003/0022711 A1 1/2003 Locke et al. ..... 463/16
2003/0036418 A1 2/2003 Seelig et al. ..... 463/16
2003/0071417 A1 4/2003 Webb ..... 273/292
2003/0114220 A1 6/2003 McClintic ..... 463/25

* cited by examiner

METHOD OF PLAYING A MATCHING BONUS GAME

FIELD OF THE INVENTION

The present invention relates to games of chance and, in particular, to the addition of a bonus game to an underlying base game wherein the bonus game includes a skill component rather than chance alone.

BACKGROUND OF THE INVENTION

Casino gaming machines and state run lotteries have proliferated in recent years. As the number of casinos and gaming outlets has increased, the competition to attract and retain new customers has intensified. To meet this competition for patrons, there is a continual need to develop new games that are exciting and entertaining. Particularly valuable are games that retain their excitement and entertainment value even after being played many times. Typically, these games allow a player to use his skill (within limits) to affect the outcome of the game. Although skill-based games tend to hold player interest and enthusiasm, they generally are not available in casino gaming machines.

Most new casino games are variations on standard casino gaming machines such as slot machines. The chief drawback of these machines is the minimal participation a player has in the outcome of the gaming event. The player merely actuates the device, and the machine selects the outcome. This lack of participation in the game and a chance to affect the game outcome quickly leads to player boredom.

Bonus games have been added to slot machines to increase player interest. These bonus games allow a player a chance to win additional awards. These bonus games, like their underlying counterparts, have outcomes dictated by chance and suffer from the same fundamental flaws as the slot machine.

The bonus games developed to date generally fall under one of two categories. The first category includes unlinked, stand-alone basic slot machine games with a bonus game. The second category includes linked slot machines wherein the game terminals are in communication through a central controller to allow players to enter a common bonus game.

An example of a bonus game is described in U.S. Pat. No. 6,190,255 to Thomas. This bonus game involves the player is a blind selection process. The player chooses symbols until he picks a winning symbol. The jackpot continually decreases with each nonwinning selection until the winning symbol is selected. No player skill is involved in the selection process and the results of the game are purely based on chance.

A similar bonus feature is described in U.S. Pat. No. 6,203,429 to Demar, which again involves a player in a blind selection process. The player accumulates awards until the "game over" symbol is picked. Again, no player skill is involved in this selection process and the results of the game are purely based on chance.

In all of the secondary events, or bonus games described above, the game play requires no skill and the results are purely dictated by chance. The player is merely a passive observer. There is no way for a player to deliberately alter the course of the game, or otherwise form a game play strategy, to affect the outcome of the game.

Recently, more sophisticated games have been provided that allow players to collaborate and compete from a network of gaming terminals. These games typically provide a group game experience such as described in U.S. Pat. No. 5,664,998, entitled "Combined Slot Machine and Racing Game," to Seelig. This patent generally describes a racetrack ancillary to a standard slot machine. The racing icons are moved around the racetrack based on the underlying slot machine play.

Another similar patent is U.S. Pat. No. 6,210,275, entitled "Progressive Jackpot Game with Guaranteed Winner" to Olsen. This is another variation of a racetrack game that allows a player to bet on a particular racing icon (e.g., a horse or car) involved in the race. The racing icon, with successive rounds of gaming, progresses around the racetrack as the player wagers on the underlying gaming machine. The player whose icon wins the race is then entitled to an additional bonus.

The problem with all of the above linked machine bonus events is the fact that the player has no direct control over the outcome of the bonus game. The player merely observes his position relative to other players. The player in the bonus game, as in the nonlinked games, is in a passive, nonthinking environment. What is desired is a new game that challenges a player's mental skills to make casino games more fun to play.

BRIEF SUMMARY OF THE INVENTION

The present invention, in one embodiment, includes a gaming machine having an underlying base game in combination with a bonus game. The base game comprises a conventional casino gaming machine, such as a slot machine. The bonus game comprises a matching game in which a player may compete for bonus awards. The present invention allows a player to wager in the regular play mode on the base game. Each time a player meets certain qualifying criteria in the base game, the player earns an opportunity to participate in the bonus game play mode.

The game field or board in which the bonus game is played comprises an array of game spaces on which indicia may be placed. These indicia may be any visual indicia including numbers, colors, images pictograms, etc. Each indicium may have a duplicate somewhere in the game space. The indicia are typically hidden during the bonus game play mode, except for brief periods when the player has an opportunity to view the indicia. The indicia are again hidden and the player has an opportunity to use his memory skills to match game spaces with the same indicium.

The bonus game awards are based on the number and quality of the matches that are made. For example, if number indicia are used, the number on the matched indicia may reflect the bonus points that the player receives. If images of playing cards are used the player wins that playing card. The playing card may then be used to develop a winning hand in a game of cards such as poker, or blackjack.

The bonus game may be further enhanced by allowing a player to have a "sneak peek" of the bonus game field or board. These are opportunities to momentarily view all, or portions of, the game area or field. These opportunities may depend on the player's success in the base game or in the bonus game. For example, the player may need to find certain markers in the bonus game, or hit certain symbols in play of the base game to be allowed a sneak peek.

A "shuffle" feature may be added to the game to offset the sneak peek feature. The player may make selections that cause the remaining hidden indicia to be shuffled, rendering useless the player's previous glimpses at the game field or board. The shuffle takes the hidden indicia and randomly repositions the game spaces on the game field or board. The "shuffle" feature may be triggered by certain specified indicia in the bonus game, after a specified number of picks, or upon other occurrences such as, for example, those discussed in the following paragraph.

At some point, the player must exit from the bonus play mode. A player may exit from the bonus game in the event of a variety of occurrences. For example, a player may continue to make selections of matching indicia until the player fails to make a match. Another approach would allow a player a number of missed matches (e.g., three missed matches) before the player exits from the bonus game. The bonus game play mode may then be ended. Another mechanism for exiting the player from the bonus game is a "stopper". A stopper comprises a specified indicia on one or more of the game spaces that ends the bonus play mode and forces the player out of the bonus game into the base game. The bonus game play may also end as a result of the bonus game board being completely played.

Once the player has exited from the bonus game play mode, the player may then attempt to requalify for the bonus game from the base game. The bonus game may change up each time the player leaves the bonus game and reenters the base game.

The apparatus for running the game may include a basic gaming machine having a base game and monetary exchanger connected with a video display upon which the bonus game is displayed. A positional selector, such as a touch screen used as the video display, light pen, joystick, mouse or other suitable device for picking game spaces is connected to the display and game for allowing players to select game spaces in the bonus game. The rules and probabilities involved in the base game differ only slightly from a conventional base game of the same type, with changes made for accommodating the bonus game (e.g., adding or changing combinations of symbols in a reel-type slot machine game to enable a player to enter the bonus game, programming some symbol combinations to allow "sneak peeks," etc.)

The advantages of this game over the prior art are substantial. Significantly, the present invention challenges a player to use his or her memorization skills. The player's ability for affecting his or her score through memorization and/or the use of sneak peeks provides a degree of control, or skill, regarding the outcome of the game for most players. The present invention enhances the entertainment value of gaming machines by involving a player in affecting the outcome of the game.

As used herein, the terms "game," "gaming" and "game of chance" include and encompass not only games having a random or arbitrary outcome, but also such games which also invite or require some player input to the game having at least a potential for affecting a game outcome. Such player input is generally termed "skill" whether or not such input is in actuality beneficial in terms of game outcome.

DETAILED DESCRIPTION OF THE INVENTION

Figure 1:
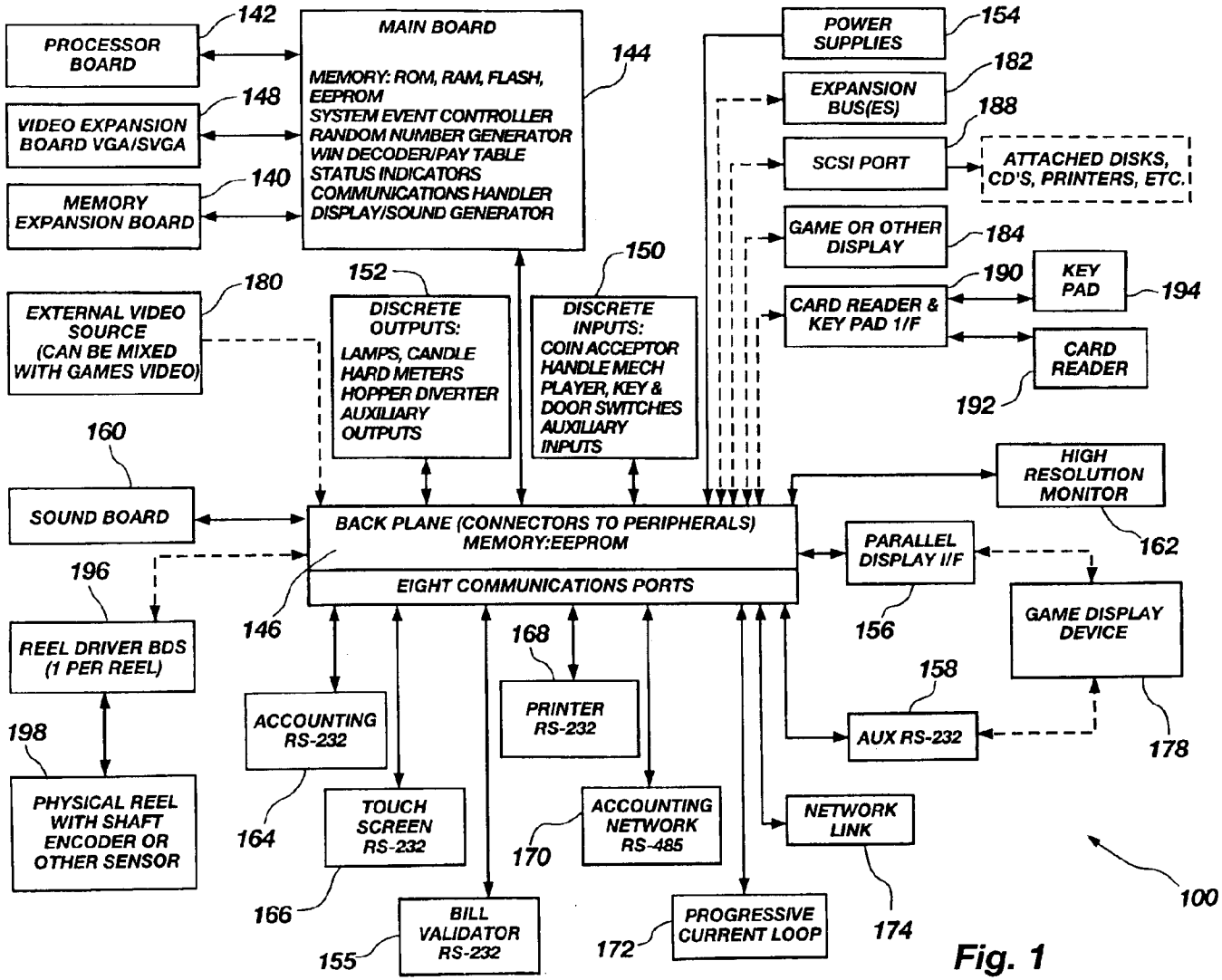
FIG. 1 depicts an interior schematic of one exemplary apparatus for implementation of the present invention.
Figure 2:
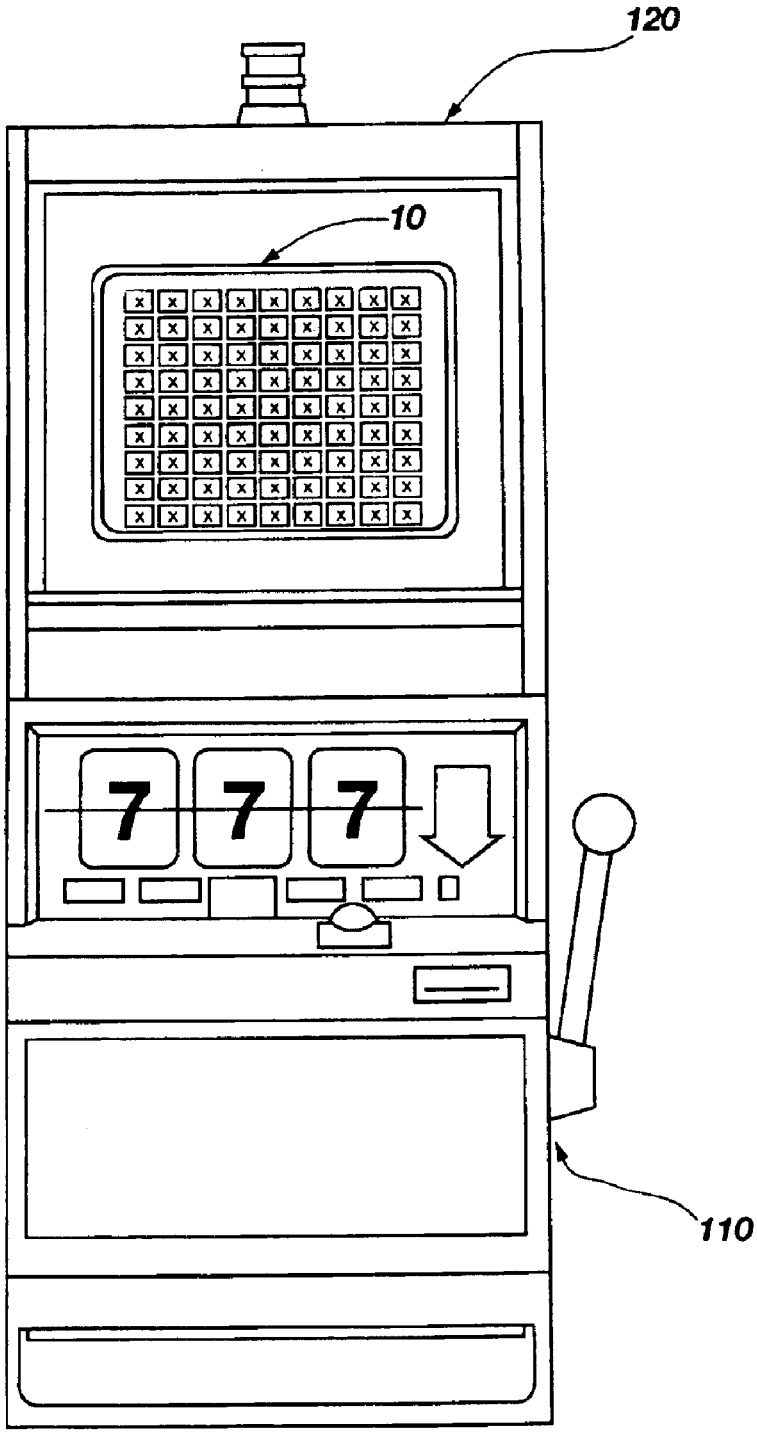
FIG. 2 depicts a front plan view of the an exemplary apparatus embodiment of the present invention including a conventional reel-type slot machine as the underlying base game and a video display topper for displaying the bonus game field or board.

As shown in drawing FIGS. 1 and 2, the present invention may be implemented as a casino gaming machine 100 with an underlying base game 110 and a bonus game played on a "top box" comprising a video display 120. The base game may be a conventional casino game such as a reel-type slot machine game. A player operates the base game until he or she qualifies for the bonus game. The qualification criteria may be any variety of potential bonus game entry barriers. For example, the qualifying criteria may require hitting certain reel symbols or combinations of symbols or obtaining a minimum number of credit awards. Once the qualifying criteria have been satisfied, the player is entered into the bonus game play mode.

In use and operation, and referring to FIG. 1, gaming machine or device 100 includes a memory board 140, a processor board 142, a main board 144 and a back plane 146 integrally or separately formed. Memory expansion board 140 as well as processor board 142 including a graphics system processor and video expansion board VGA/SVGA 148, are operably coupled to the main board 144. The main board 144 preferably includes memory in the form of ROM, RAM, flash memory and EEPROM (electrically erasable programmable read only memory). In addition, the main board 144 includes a system event controller, a random number generator, a win decoder/pay table, status indicators, a communications handler and a display/sound generator.

The main board 144 is operably coupled to the back plane 146, which may include additional memory, such as in the form of an EEPROM, and connectors to connect to peripherals. Furthermore, the back plane 146 provides a plurality of communication ports for communicating with external peripherals. The back plane 146 provides the coupling between discrete inputs 150 and the processor board 142 and main board 144. Typical examples of elements which provide discrete inputs 150 are coin acceptors, game buttons, mechanical hand levers, key and door switches and other auxiliary inputs. Furthermore, the back plane 146 provides the coupling between discrete outputs 152 and the processor board 142 and main board 144. Typically and by way of example only, elements that provide discrete outputs 152 are in the form of lamps, hard meters, hoppers, diverters and other auxiliary outputs.

The back plane 146 also provides connectors for at least one power supply 154 for supplying power for the processor and a parallel display interface (PDI) 156 and a serial interface 158 for game display device 178. In addition, the back plane 146 also provides connectors for a soundboard 160 and a high-resolution monitor 162. Furthermore, the back plane 146 includes communication ports for operably coupling and communicating with an accounting network 164, a touch screen 166 (which may also serve as a game display device), a bill validator 155 incorporated in a currency (bill) acceptor, a printer 168, an accounting network link 170, a progressive current loop 172 and a network link 174.

The back plane 146 optionally includes connectors for external video sources 180, expansion buses 182, game or other displays 184, an SCSI port 188 and an interface 190 for at least one card reader 192 (debit/credit, player card, etc.) and key pad 194. The back plane 146 may also include means for coupling a plurality of reel driver boards 196 (one per reel) which drive physical game reels 198 with a shaft encoder or other sensor means to the processor board 142 and main board 144 if a gaming device 100 is configured for play of a reel-type game as the base game. Of course, the reels may be similarly implemented electronically by display as video images, technology for such an approach being well known and widely employed in the art. In such an instance reel driver boards 196 and physical game reels 198 with associated hardware are eliminated and the game outcome generated by the random number generator on main board 144 is directly displayed on a video game display 184 and, optionally, on a separate game display device 178, as known in the art. Other gaming machine configurations for play of different wagering games such as video poker games, video blackjack games, video Keno, video bingo or any other suitable primary games are equally well known in the art. It will also be understood and appreciated by those of ordinary skill in the art that selected components of gaming machine or device 100 may be duplicated for play of a stand-alone bonus game or event in accordance with the present invention, in that at least a separate board with a second processor may be employed, with associated peripherals and links thereto, for play of the bonus game. In the conventional situation wherein the bonus game of the present invention may be operably coupled as a "top box" or otherwise associated with a conventional, existing gaming machine configured for play of a base game, many of the components illustrated in FIG. 1 and described with respect thereto will be duplicated, including separate software and associated memory for conducting play of the bonus game with associated pay tables for the bonus awards.

Figure 6:
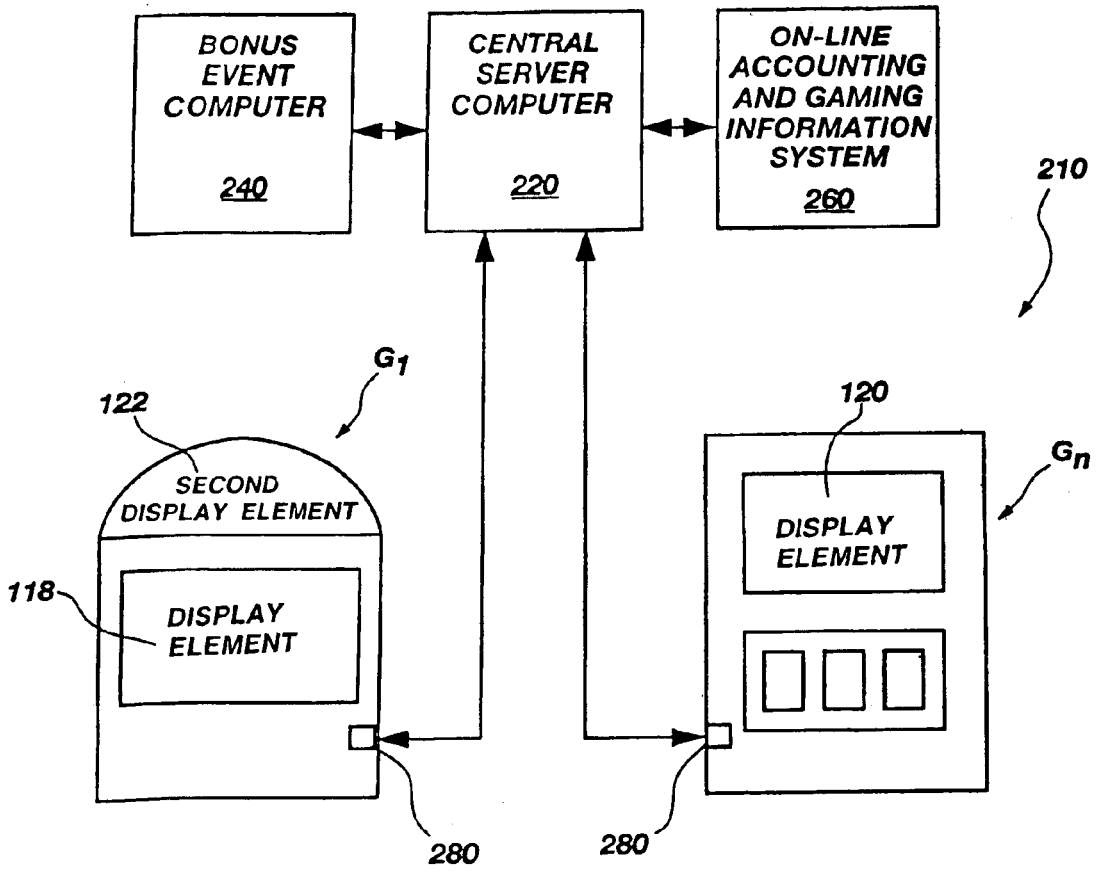
FIG. 6 depicts a gaming network including a plurality of gaming machines offering bonus games according to the present invention.

In implementation of the present invention, the gaming machines offering play of the bonus event of the present invention may be deployed, as schematically depicted in FIG. 6, in a gaming network 210 including a central server computer 220 operably coupled to a plurality of gaming machine $G_1$, $G_2$ . . . $G_n$ which may include both electronic and reel type gaming machines. It is notable that, unless the gaming network 210 is configured for progressive play, a variety of different makes of gaming machines $G_1$, $G_2$ . . . $G_n$ offering widely different games may incorporated in gaming network 210, since the bonus event operates independently of the base or primary game on each gaming. The central server computer 220 automatically interacts with a plurality of gaming machines $G_1$, $G_2$ . . . $G_n$ to activate a bonus event.

More specifically, and again referring to FIGS. 1 and 6, the gaming network 210 includes a central server computer 220, a bonus event computer 240 and a plurality of gaming machines $G_1$, $G_2$ . . . $G_n$. Each gaming machine $G_1$, $G_2$ . . . $G_n$ includes a controller assembly 280 operably coupled to the central server computer 220 and is comprised of a controller unit designed to facilitate transmission of signals from each individual gaming machine $G_1$, $G_2$ . . . $G_n$ to central server computer 220 for monitoring purposes. In addition, the controller assembly 280 includes a network interface board fitted with appropriate electronics for each specific make and model of each individual gaming machine $G_1$, $G_2$ . . . $G_n$.

Referring to FIG. 6, in electronic video games, the central server computer 220 is operably coupled to at least one video game display element 118 as shown at the left hand side of FIG. 2 and sequesters a portion of the video game display element 118 for displaying video attract sequences to attract potential players. Video game display element 118 may be used for display of both the base or primary and bonus games. Where the gaming network 210 includes reel type game machines $G_1$, $G_2$ . . . $G_n$, as shown at the right hand side of FIG. 6, the central server computer 220 may be operably coupled to at least one active display element 120 (depicted in FIG. 2) so that potential players receive a clear indication of attract sequences and the active display element 120 may be used as a video display for the bonus game. As shown at the left hand side of FIG. 6, the gaming machines $G_1$, $G_2$ . . . $G_n$ may also be provided with a second video display element 122 as an alternative to sequestering a portion of the video game display element 118 for displaying video attract sequences and the bonus game. In addition, the central server computer 220 may include sound generating hardware and software for producing attractive sounds orchestrated with the video attract sequences at each of gaming machines $G_1$, $G_2$ . . . $G_n$ if such is not already incorporated therein. The games support input and output between the player and the game for such devices as heads up display, joystick, keyboard, mouse and data glove via interface modules connected through the expansion bus or buses 182 and SCSI port 188.

The attractive multimedia video displays and dynamic sounds may be provided by the central server computer 220 by using multimedia extensions to allow gaming machines $G_1$, $G_2$ . . . $G_n$ to display full-motion video animation with sound to attract players to the machines. During idle periods, the gaming machines $G_1$, $G_2$ . . . $G_n$ preferably display a sequence of attraction messages in sight and sound. The videos may also be used to market specific areas of the casino and may be customized to any informational needs.

Furthermore, the gaming network 210 includes bonus event computer 240 operably coupled to the central server computer 220 for scheduling bonus parameters such as the bonus game configuration, pay tables and players. The functions of central server computer 220 and bonus event computer 240 may, of course, be combined in a single computer. Preferably, the gaming network 210 further includes a real-time or on-line accounting and gaming information system 260 operably coupled to the central server computer 220. The accounting and gaming information system 260 includes a player database for storing player profiles, a player tracking module for tracking players and a pit, cage and credit system for providing automated casino transactions.

Figure 7:
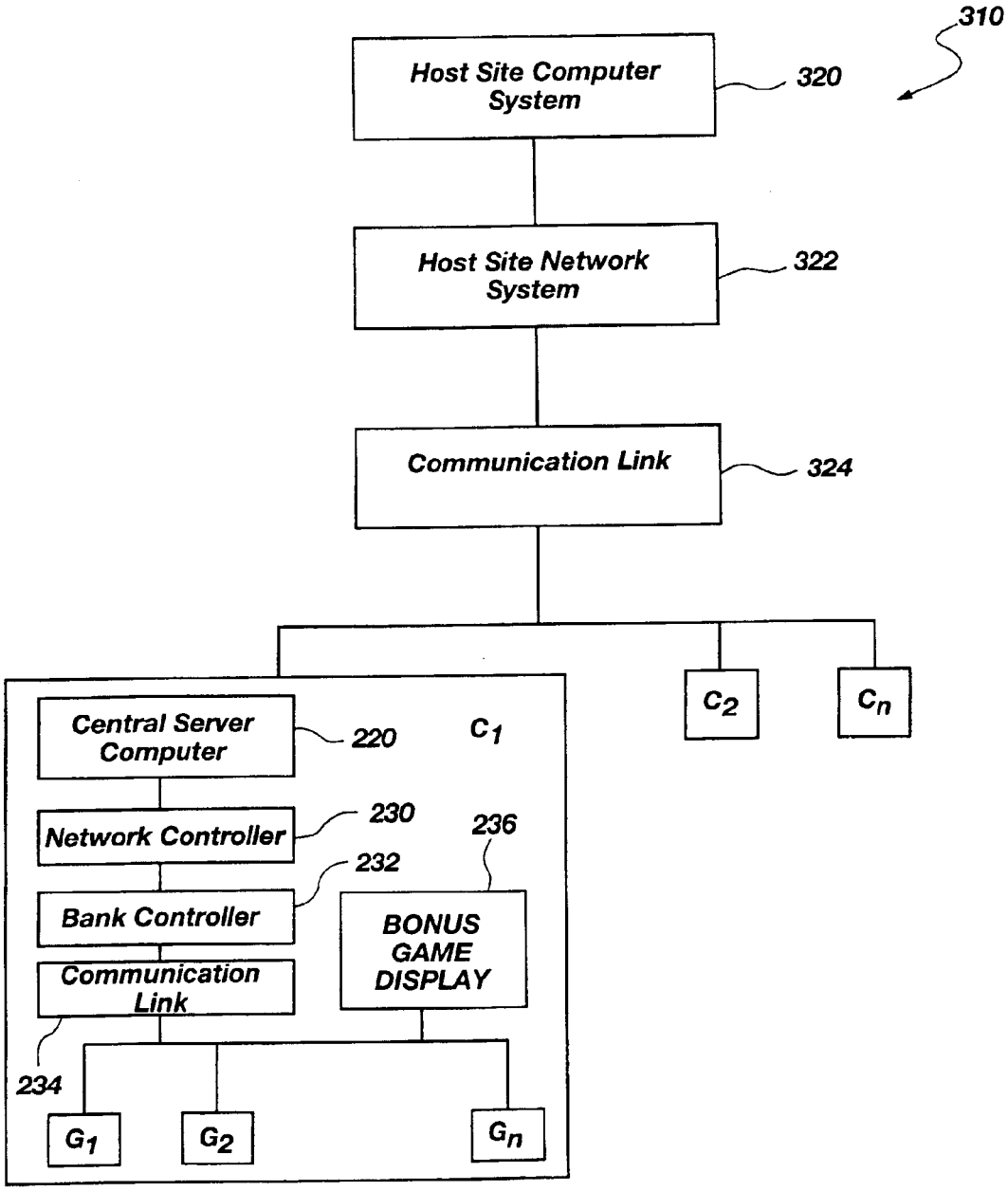
FIG. 7 depicts a multi-site gaming system including a plurality of the networks depicted in FIG. 6.

As previously implied, a bank of gaming machines $G_1$, $G_2$ . . . $G_n$ may be networked together in a progressive configuration, as known in the art, wherein a portion of each wager to initiate a base or primary game may be allocated to bonus event wards. In addition, and referring to FIG. 7, a host site computer 320 is coupled to a plurality of the central servers 220 at a variety of mutually remote casinos or other gaming sites $C_1$, $C_2$ . . . $C_n$ for providing a multi-site linked progressive automated bonus gaming system 310.

Preferably, the host site computer 320 will be maintained for the overall operation and control of the gaming system 310. The host site computer 320 includes a host site network system 322 and a communication link 324 provided with a high-speed, secure modem link for each individual casino site $C_1$, $C_2$ . . . $C_n$.

Each casino or other gaming site $C_1$, $C_2$ . . . $C_n$ includes the central server computer 220 provided with a network controller 230 which includes a high-speed modem operably coupled thereto. Bidirectional communication between the host site computer 320 and each casino site central server 220 is accomplished by the set of modems transferring data over communication link 324.

A network controller 230, a bank controller 232 and a communication link 234 are interposed between each central server 220 and the plurality of networked gaming machines at each casino site $C_1$, $C_2$ . . . $C_n$. In addition, the network controller 230, the bank controller 232 and the communication link 234 may optionally be interposed between each central server 220 and at least one separate bonus game display 236 at each casino site $C_1$, $C_2$ . . . $C_n$. However, the system 310 may include hardware and software to loop back data for in-machine meter displays to communicate with bonus event award insert areas on gaming machines $G_1$, $G_2$ . . . $G_n$.

Gaming machines $G_1$, $G_2$ . . . $G_n$ may be connected to bonus game display 236 through communication link 234. Communication link 234 may be any of a variety of communication links known in the art, including, but not limited to: twisted-pair wire, coaxial cable, fiber optic, Ethernet, token ring, bus line, Fibre Channel, ATM, standard serial connections, LAN, WAN, Intranet, Internet, radio waves, or other wireless connections.

It will be appreciated to those of ordinary skill in the art that another embodiment may employ some or all gaming machines $G_1$, $G_2$ . . . $G_n$ in the form of personal computers located at sites remote from the host site computer 320. The personal computers may be located in homes, businesses or other locations remote from the host site computer 320, such as a casino site $C_1$, $C_2$ . . . $C_n$. In this embodiment, the personal computers are configured such that the personal computer may connect to host site computer 320 through a network, such as the Internet. The personal computers are enabled to participate in gaming activities by downloading software, wherein the software provides access to the gaming activities and configures the personal computer for play of the gaming activity. In such a configuration, both base and bonus games may be conducted and controlled from the host site computer 320.

Thus, it will be appreciated that the bonus game of the present invention may be implemented as a stand-alone bonus game on a gaming machine 100, as a bonus game administered to a bank or other plurality of gaming machines $G_1$, $G_2$ . . . $G_n$ over a gaming network 210 by a bonus event computer 240, or as a bonus game administered over a gaming system 310 to multiple, mutually remote casinos or other gaming sites $C_1$, $C_2$ . . . $C_n$. Also as previously noted, the bonus game may have fixed awards or prizes associated therewith, or the bonus game as administered over gaming network 210 or gaming system 310 may be structured as a progressive, wherein a portion of base or primary game wagers are allocated to a bonus pool. Of course, both progressive and non-progressive bonus games may be offered concurrently, the type of bonus game enabled being related to specific base or primary game outcomes or, optionally, a progressive bonus game may be enabled by certain outcomes during play of a stand-alone bonus game or a networked but not progressive bonus game.

Figure 3:
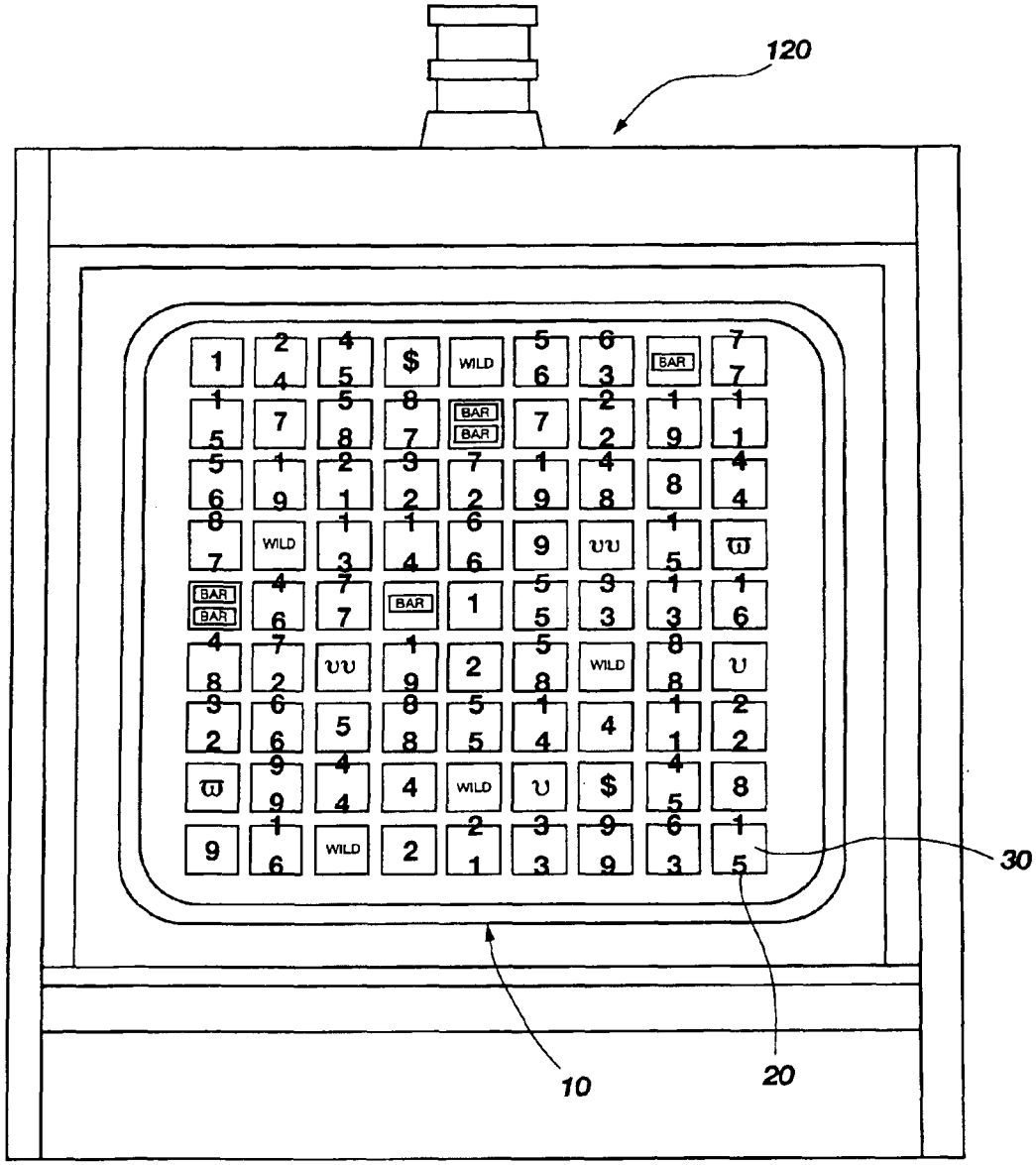
FIG. 3 depicts an enlarged view of the video display of FIG. 2 depicting the bonus game "sneak peek" feature on the bonus game field or board.
Figure 4:
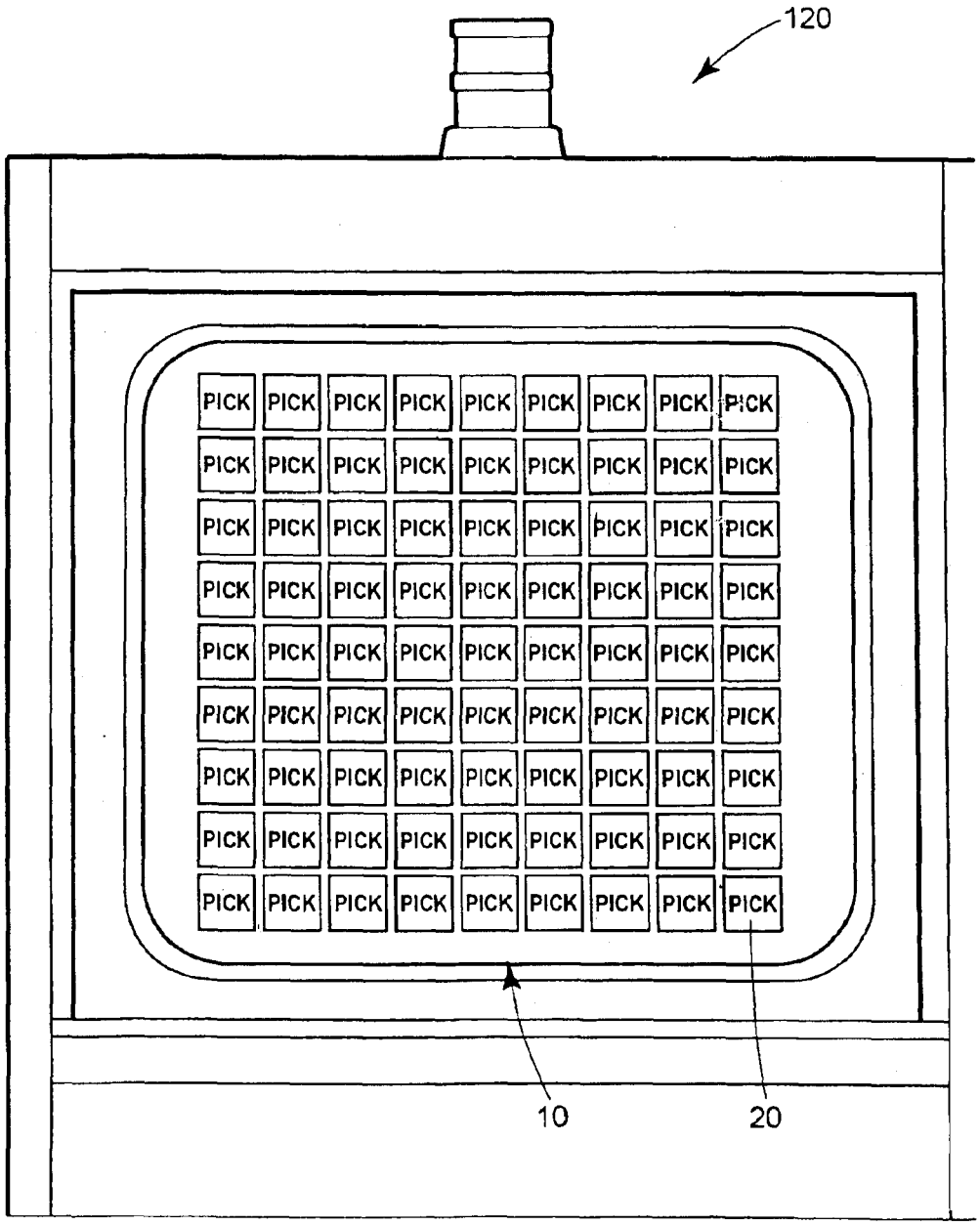
FIG. 4 depicts an enlarged view of the video display of FIG. 2 depicting the bonus game field or board prior to a player making selections.

Depicted in drawing FIG. 4 is the starting position of the bonus game of the present invention with all of the bonus game indicia hidden from player view. The bonus game is comprised of a game field or board 10 including a plurality of game spaces 20 in an array. The game field or board may be divided into any suitable array pattern formed by the discrete game spaces. In the illustrated embodiment, the game spaces 20 are formed in a rectangular matrix. Each game space 20 has associated indicia 30, shown in drawing FIG. 3, which may be numbers, symbols, or colors. The indicia 30 generally consist of a plurality of matching indicia. For example, in one embodiment, there is at least one matching indicium 30 on the game field or board 10 for each game space 20. To further increase the odds of matching indicia 30, more than one matching indicia 30 may be placed on the board. For example, there may be three or more indicia 30 that display the number "100". The greater the number of matching indicia 30, the greater the chance the player has to match an indicium 30. To minimize a player's chance of selecting matching indicium 30, only one pair of matching indicia 30 may be available on the game field or board 10.

The bonus game of the present invention comprises a process for winning bonus awards by matching indicia 30 on two or more game spaces 20. The indicia 30 are generally hidden during bonus game play. The only time the indicia 30 are revealed is at the start of the bonus game when the player is allowed to briefly view the indicia 30. The game field or board 10 reverts to the hidden indicia mode depicted in drawing FIG. 4 after a specified period. The indicia 30 in game spaces 20 may also be briefly revealed when a player earns a "sneak peek" during play of the base game or the bonus game. Depicted in drawing FIG. 3 are both the sneak peek feature and the initial opening of the bonus game when a player is given the opportunity to memorize revealed indicia 30 on the game field or board 10. The sneak peek feature may be earned based on matching certain indicia 30, revealing specified indicia 30, earning a minimum number of points, etc. Otherwise, during the bonus game, the player only sees a pair of indicia 30 that he has selected for an attempted match.

Figure 5:
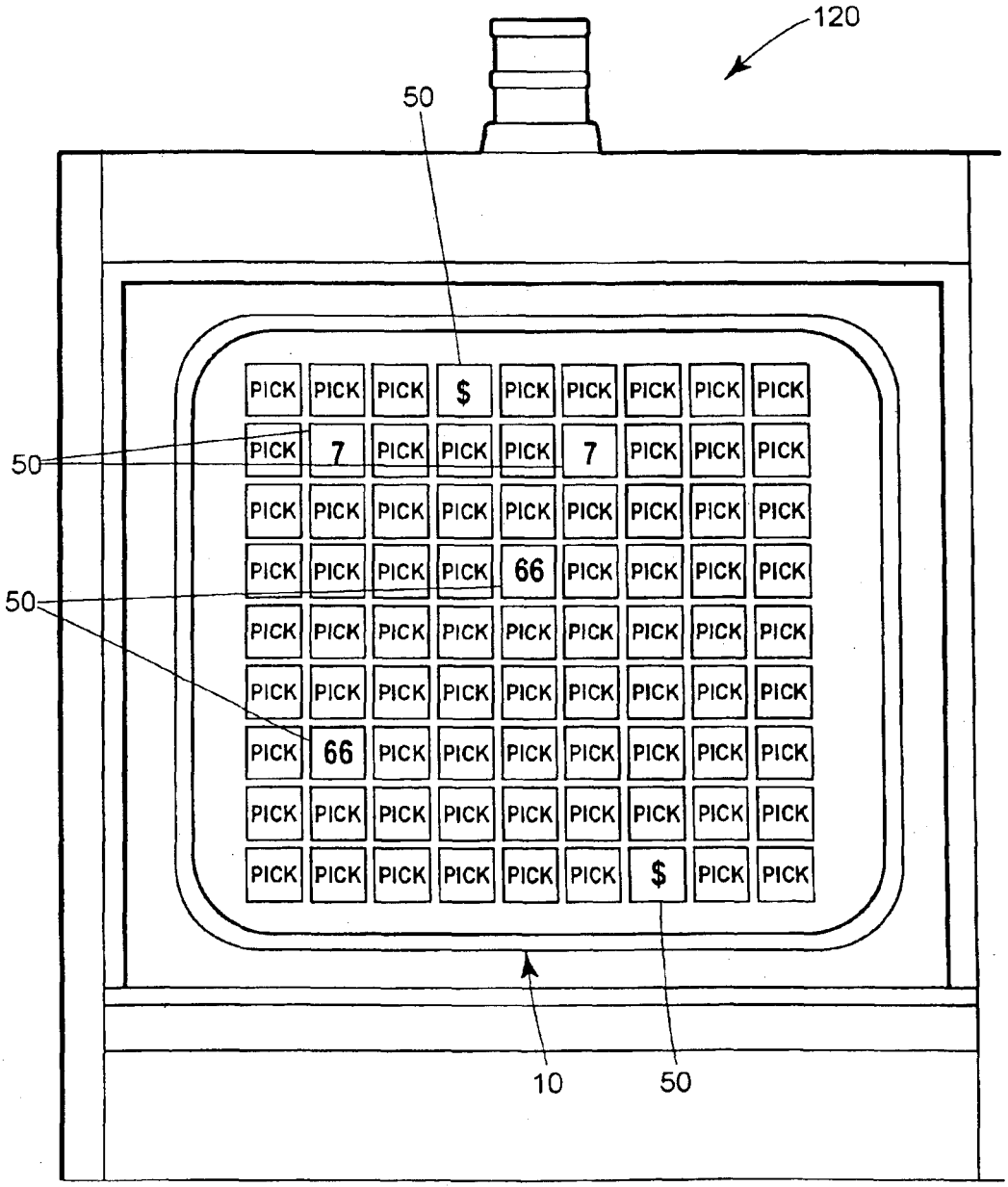
FIG. 5 depicts an exemplary bonus game field or board configuration depicting a matching set of indicia that is awarded 50 bonus points.

After the initial brief revealing of indicia 30 on bonus game field or board 10, the player is next allowed to select specific game spaces 20 in an attempt to match the indicia 30 on those game spaces 20. The indicium 30 associated with a first selected game space 20 is revealed as the player makes his selection. The player next attempts to select another game space 20 with associated indicium 30 that matches the indicium 30 associated with the previously selected game space 20. If the two selected, revealed indicia 30 match as shown at 50 in FIG. 5, the player is awarded the prize indicated by the indicia match 50, and is allowed to continue to attempt to select pairs of game spaces 20 with matching indicia 30. If the revealed indicia 30 of the next pair of selected game spaces 20 do not match, the player is returned to the base game play mode. Illustrated in drawing FIG. 5 is a player who has matched both the numbers "7" and "66" and the "$" image.

Players may develop a strategy to search and match the indicia 30 in game spaces 20 that indicate the largest prizes. Alternately, the player may simply try to find the indicia 30 that are most easily matched. The game field or board 10 may also contain game spaces 20 that provide special awards such as a "wild card" resulting in an automatic match with the indicia 30 of the next selected game space 20, a sneak peek, etc.

In one embodiment of the present invention, the indicia 30 are distributed in a rectangular matrix of square game spaces 20 that is displayed on the video display 120. Each square game space 20 takes on the appearance of a block that can revolve independently of all other blocks (games spaces 20) and reveal the indicia 30 on that block. The block may continue to revolve, again hiding the indicia 30 on the block.

At the start of the bonus play mode the player is given an opportunity to shortly view either all or a portion of the game spaces 20 with their associated indicium 30 (See FIG. 4.). The indicium 30 on a square game space 20 is not visible until the player selects that square game space 20. Once the square game space 20 is selected, the indicium 30 associated with that square game space 20 is displayed or revealed. The player then selects another square game space 20 with a hidden indicium 30 in an effort to match the indicium 30 displayed on the last selected square game space 20. If the indicia 30 match 50 (FIG. 5), the corresponding award associated with the matched square game spaces 20 is credited to the player. If the indicia 30 on the squares do not match, the revealed indicia 30 of the square game spaces 20 are returned to their hidden position.

In another embodiment of the present invention, rather then awarding bonus points for matched game spaces 20, the player obtains the indicia 30 that are matched and is allowed to place those indicia 30 in either the bonus or base game to further the potential for winning an award in either the base or bonus game. For example, the bonus game may employ indicia of playing cards. The bonus game is won by matching indicia 30 to collect a winning card hand. In one exemplary embodiment, a player is required to create a poker hand in the bonus game. Each of the game spaces 20 may have associated with it an indicium 30 representing a playing card. The player is given a finite number of opportunities to find matching pairs of cards. He may be given, for example, five opportunities to find a matching pair of game spaces 20 to form a five card poker hand. A good player may be able to attain a royal flush, a lesser player a full house. A winning hand is credited with a bonus award commensurate with the hand created. This same game could be played based on other card games as well (e.g., blackjack).

At some point, the bonus game field or board 10 will need to be renewed as prizes are matched. This may be done in a number of ways. One method is to allow a player to win a maximum prize award before the game field or board 10 is renewed. Another method is to renew the game field or board 10 after the player has failed to match indicia 30 of game spaces 20 a specified number of times. Another alternative is to substantially continuously renew the game field or board 10 to add indicia-containing game spaces 20 each time indicia 30 are matched. This adds another level of complexity to the game, making it more difficult for a player because of the ongoing changes in the game field or board 10. The termination of the bonus game may occur in response to any of these possibilities. Once the bonus game is terminated, the bonus game field or board 10 may be randomly reset.

The base game awards may be based on typical slot machine pay out schedules or pay tables. To increase the flexibility of the game, it is possible to award players certain benefits or advantages associated with the bonus game based on the outcomes obtained during base game play. For example, certain specified outcomes that enable or qualify a player to have a sneak peek of the revealed indicia may appear in play of the base game. Once the player enters the bonus game, the sneak peek "award" won in base game play may be activated to obtain an advantage in selecting matching indicia 30. The sneak peak may be provided, depending upon configuration of the bonus game, at a preset time during bonus play, at the player's instigation, upon revealing a selected indicium 30, at a random time, or otherwise as determined to be appropriate by the gaming establishment operating the bonus game. Of course, the sneak peak advantage may also be offset in the game architecture by shuffling the locations of the indicia 30 in the game spaces after a predetermined number of game space selections, or otherwise as deemed appropriate to maintain a fairly consistent payout.

It will also be apparent that that bonus game of the present invention may be implemented in different variations, responsive to different outcomes of the associated base game. For example, one reel combination may enable a "5×" or 10×" money match, where a user is prompted to play a bonus game round and the first two matching indicia 30 result in a bonus award of 5 times or 10 times the value of the matched indicia. Another variation, enabled by a different reel combination, ma be termed a "prize match", wherein the casino or other gaming establishment operating the bonus game has preentered its own prizes in the array of game spaces 20 and the first match awards the depicted or associated prizes. Another variation is a timed event which may be termed a "money match frenzy". In this instance, a qualified player has a given time, for example 30 seconds, to match as many sets of indicia 30 in gaming spaces 20 as possible. The total of all the matched indicia sets is the value of the bonus award.

Yet another implementation, as previously noted, is a multi-tiered bonus game. Each tier or level is more difficult than the preceding one, but competing at higher levels results in higher bonus awards. Bonus game play at any level may be triggered by specific reel combinations. Insofar as this approach may take an extended amount of time in terms of both base game play and various levels of bonus game play, it is contemplated that such an approach may be enabled by conventional player tracking technology such as a smart card or player tracking card, so that a player's personal progress and current status in bonus game play (e.g., the level or tier, accumulated sneak peeks, etc.) may be stored at the end of a gaming session and the bonus game "reset" in a future gaming session conducted from the prior termination point in the bonus game. Thus, a player would not be forced to leave points or other bonus game advantages on a gaming machine at the end of a gaming session leaving an uncompleted bonus game for use by a subsequent player. Of course, player tracking may be used similarly with single-tier bonus games according to the present invention, although the relative brevity of a single-tier game would normally not require this feature.

Moreover, having thus described the invention, it should be apparent that numerous structural modifications and adaptations may be resorted to without departing from the scope and fair meaning of the instant invention as set forth above and as described by the claims.

We claim:

1. A gaming method comprising:

displaying an image representing a game;

determining if an event has occurred;

displaying, as part of a bonus game, an array including a plurality of spaces if the event has occurred, each of the plurality of spaces having an indicium associated therewith that matches with at least one other indicium associated with another of the plurality of spaces;

revealing the indicia associated with the plurality of spaces for a period of time when a requirement occurs during the game, the requirement comprising one of matching certain indicia, revealing a specified indicium, and reaching an achievement level;

concealing the indicia associated with the plurality of spaces after revealing the indicia for the period of time;

receiving a first selection of one of the plurality of spaces after revealing the indicia for the period of time, revealing the indicium associated with the one of the plurality of spaces;

receiving a second selection of another of the plurality of spaces;

revealing the indicium associated with the another of the plurality of space;

determining if the indicia associated with the one and the another of the plurality of spaces match; and providing an award if the indicia associated with the one and the another of the plurality of spaces match.

2. The gaming method of claim 1 further comprising:

concealing the indicia associated with the one and the another of the plurality of spaces if the indicia do not match;

receiving a third selection of a third one of the plurality of spaces;

revealing the indicium associated with the third one of the plurality of spaces; and receiving a fourth selection of a fourth one of the plurality of spaces.

3. The gaming method of claim 1 further comprising:

returning the player to the game if the indicia associated with one and the another of the plurality of spaces do not match.

4. The gaming method of claim 1 wherein providing the award further comprises:

providing a game indicium for use in the game if the indicia associated with one and the another of the plurality of spaces match.

5. The gaming method of claim 1 further comprising randomly reassociating each of the plurality of spaces and the indicium associated therewith.

6. The gaming method of claim 1 wherein revealing the indicia associated with the plurality of spaces for the period of time further comprises revealing the indicia for a period of time corresponding to one of matching certain indicia, revealing a specified indicium, and reaching an achievement level during the game.

7. The gaming method of claim 1 further comprising:

repeating a selection process, the selection process comprising:

receiving a third selection of a third one of the plurality of spaces;

revealing an indicium associated with the third one of the plurality of spaces;

receiving a fourth selection of a fourth one of the plurality of spaces;

revealing an indicium associated with the fourth one of the plurality of spaces; and determining if the indicia associated with the third one and the fourth one of the plurality of spaces match.

8. The gaming method of claim 7 further comprising repeating the selection process a number of times.

9. The gaming method of claim 7 further comprising repeating the selection process until a special game end indicium is revealed.

10. The gaming method of claim 7 further comprising:

repeating the selection process;

collecting matches into a collection of matches;

evaluating the collection of matches;

assigning a value to the collection of matches; and awarding a payout based on the value assigned to the collection of matches.

11. The gaming method of claim 1 further comprising:

determining if the indicium associated with one of the one and the another of the plurality of spaces is a wild indicium;

awarding an automatic match when the indicium associated with one of the one and the another of the plurality of spaces is a wild indicium.

* * * * *